US012545495B2

(12) United States Patent
Munoz Enriquez

(10) Patent No.: US 12,545,495 B2
(45) Date of Patent: Feb. 10, 2026

(54) BOOT SHOE PACKAGING THAT INCLUDES A SHELF FOR CARE

(71) Applicant: Clara Lizbet Munoz Enriquez, Guanajuato (MX)

(72) Inventor: Clara Lizbet Munoz Enriquez, Guanajuato (MX)

( * ) Notice: Subject to any disclaimer, the term of this patent is extended or adjusted under 35 U.S.C. 154(b) by 0 days.

(21) Appl. No.: 18/888,708

(22) Filed: Sep. 18, 2024

(65) Prior Publication Data

US 2025/0197098 A1 Jun. 19, 2025

(30) Foreign Application Priority Data

Dec. 15, 2023 (MX) ..... MX/u/2023/000583

(51) Int. Cl.
*B65D 5/50* (2006.01)
*B65D 85/18* (2006.01)

(52) U.S. Cl.
CPC ..... *B65D 85/187* (2013.01); *B65D 5/5035* (2013.01)

(58) Field of Classification Search
CPC .. B65D 5/4804; B65D 5/5035; B65D 85/187; B65D 21/0224; B65D 71/70; B65D 57/02; B65D 57/003; B65D 57/005
See application file for complete search history.

(56) References Cited

U.S. PATENT DOCUMENTS

| | | | | |
|---|---|---|---|---|
| 2,142,793 | A * | 1/1939 | Lipkin | B65D 5/48042 229/120.32 |
| 8,668,082 | B2 * | 3/2014 | Greene | B65D 37/00 229/148 |
| 8,783,547 | B2 * | 7/2014 | Tabor | B65D 5/32 108/51.3 |
| 8,967,455 | B2 | 3/2015 | Zhou | |
| 2015/0129449 | A1 * | 5/2015 | Patterson | B65D 85/48 206/454 |
| 2022/0041368 | A1 * | 2/2022 | Weiss | B65D 25/10 |

FOREIGN PATENT DOCUMENTS

| | | |
|---|---|---|
| CN | 107521795 | 12/2017 |
| ES | 2663909 | 4/2018 |

* cited by examiner

*Primary Examiner* — Mollie Impink
(74) *Attorney, Agent, or Firm* — Defillo & Associates, Inc.; Evelyn A. Defillo

(57) ABSTRACT

A packaging for footwear of the boot type or in general for that footwear that have an extension that covers the user's calf and therefore have such a length that for their care, they need special shelves, where the footwear is not injured, such packaging takes care of, protects and allows to keep the footwear in good condition without damaging its quality. Among the significant advantages is that it allows the shelf to be used as a way to conserve footwear, it is ecological, because the way of transportation allows to give a second and main use as the protection of the footwear. With traditional packaging, much more cardboard is wasted or causes a large number of contaminants than if it is given a second use, and it also contaminates less, helping the environment.

1 Claim, 7 Drawing Sheets

BOOT SHOE PACKAGING THAT INCLUDES A SHELF FOR CARE

FIELD OF THE INVENTION

The present invention refers to a packaging for footwear of the boot type or in general for that footwear that has an extension that covers the user's calf and therefore has such a length that for its care, it needs special shelves where the footwear is not injured, such packaging takes care of, protects and allows keeping the footwear in good condition without harming its quality. The invention involves 10 mechanical elements so it is considered an invention of this type.

BACKGROUND

Conventionally, footwear requires special cares for its transportation and for its care once it is no longer in use and, in some way, its packaging and storage extend its useful life and keep it in good condition, preserving its quality.

With traditional packaging, much more cardboard is wasted or causes a large number of contaminants than if it is given a second use, it also contaminates less, helping the environment.

In the state of the technique, there are numerous packaging's designed for footwear, such as the most traditional ones represented by a rectangular prismatic box with a lid that is coupled or folded laterally, or sometimes the lids form a single piece cut and assembled from the folds that are pre-sliced or cut to give body to the box.

In other embodiments, the packaging includes a piece of thin paper that individually wraps each piece of footwear, or in other cases each piece is placed separately in a fabric, plastic or paper bag in order to keep the surface of the footwear clean.

Some patents that have been protected of this type are as follows:

Patent ES2663909T3 entitled packaging and blank comprising an improved footwear element, which claims a packaging obtained from a single blank, pre-trimmed and folded from a sheet of material, of a kind comprising: —an outer casing (14) consisting of at least three external articulated panels (121-124) successively to each other around longitudinal folding lines (131-133) extending parallel to each other according to the longitudinal direction, the folding lines defining longitudinal sides of the outer panels, the outer casing closing on itself to define a closed contour around an interior space in a transverse plane perpendicular to the longitudinal direction; —a footwear element (12) comprising a main casing comprising at least three main panels (21-24) articulated successively to each other around longitudinal folding lines (31-33) extending parallel to each other according to a longitudinal direction, the folding lines defining longitudinal sides of the panels, the main wrapper closing on itself to define a closed contour around an inner space of the footwear element in a transverse plane perpendicular to the longitudinal direction; characterized in that the footwear element comprises, in at least one longitudinal end, an end footwear device (60, 80, 60', 80') comprising: —an extreme band (60, 60') comprising as many end panels (61-64, 61'-64') as the number of main panels of the footwear element, hinged successively to each other around folding lines (71-73) arranged in the alignment of the folding lines of the main panels, the end band closing on itself to define a closed contour around an interior space of the footwear element in a transverse plane perpendicular to the longitudinal direction, —for at least two different main panels, at least one longitudinal joining leg (80, 80') joining the main panel to a corresponding end panel, and the joining leg of one main panel being distinct from the joining leg or legs of the other main panels, the legs being joint separated from each other transversely by a separating cutout (82, 82') on the sheet material, and whereby each joining leg (80, 80') comprises an intermediate folding line (84, 84'), transverse, delimiting a main part (80a, 80'a) and an end part (80b, 80'b) of the joining leg, respectively attached to the corresponding main panel and end panel, to enable an approach of the end band of the main wrap by folding the two parts of the joining leg back on themselves around the intermediate folding line.

The patent CN107521795B, denominated box and package which claims a case having an opening surrounded by a plurality of edges; a first cover continuous and extending from a first edge between the plurality of edges defining the opening in the case, and foldable along the first edge to cover the opening; and a latching tab continuous with and extending from a second edge of the plurality of edges of the first cover that is different from the first edge, the latching tab being foldable and attachable with the storage stored in the case when the first cover is folded along the first edge to cover the opening.

Another patent of the type is identified as U.S. Pat. No. 8,967,455B2 called a cardboard structure claiming a cardboard structure including a sidewall panel, a first end panel, a second end panel, a first side panel and a second side panel. The first and second end panels are connected to the sidewall panel, respectively. The first and second side panels extend outwardly from two opposite edges of the second end panel, wherein the first and second side panels are pressed by the edges of the first end panel to make a stop against the side wall panel so that the opening of the cardboard structure can be closed.

DESCRIPTION

The characteristic details of this innovative boot packaging, which includes a shelf for shoe care, are clearly shown in the following description and in the accompanying figures, where the same reference signs are shown to indicate the parts and figures shown.

DESCRIPTION

Figure 1:
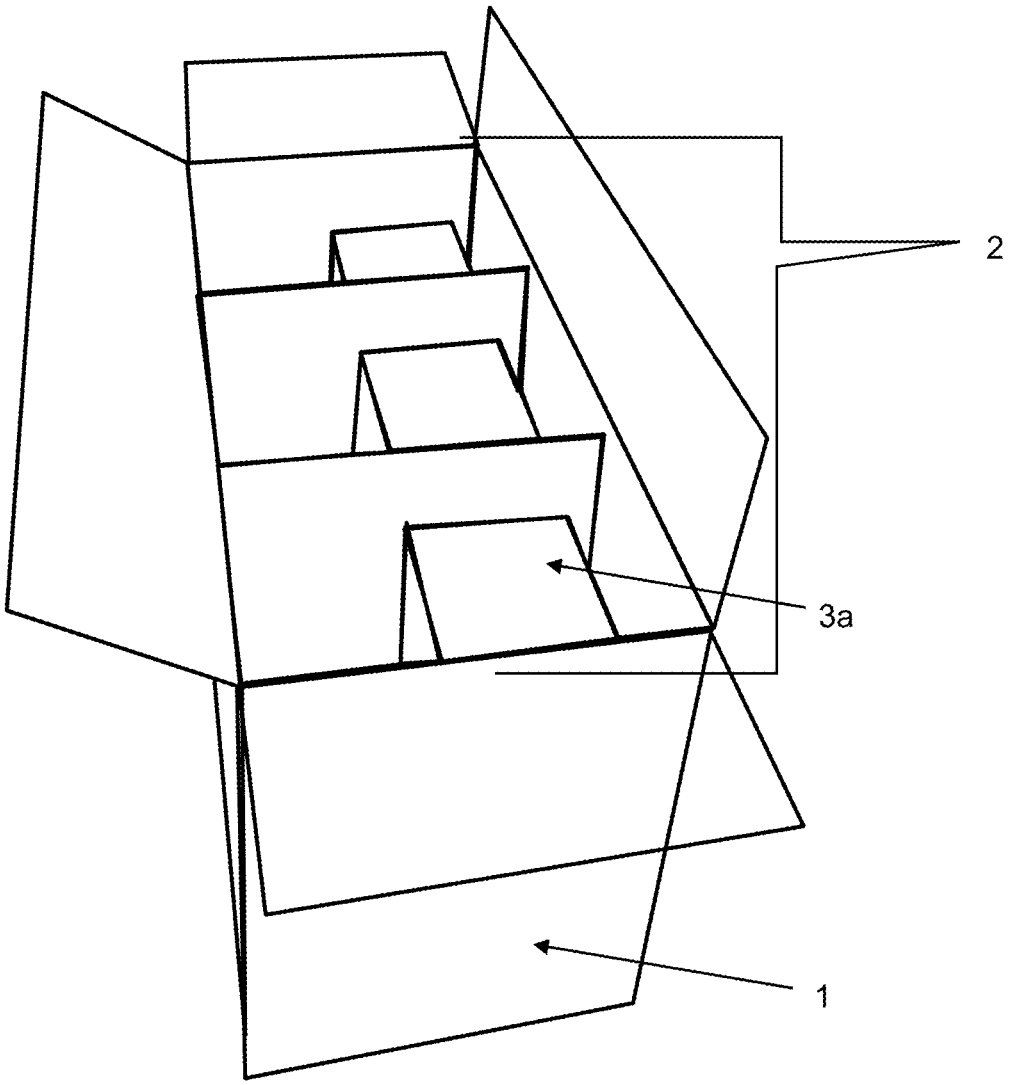
FIG. 1 is a conventional top perspective view of boot-type footwear packaging that includes a shelf for its care.
Figure 2:
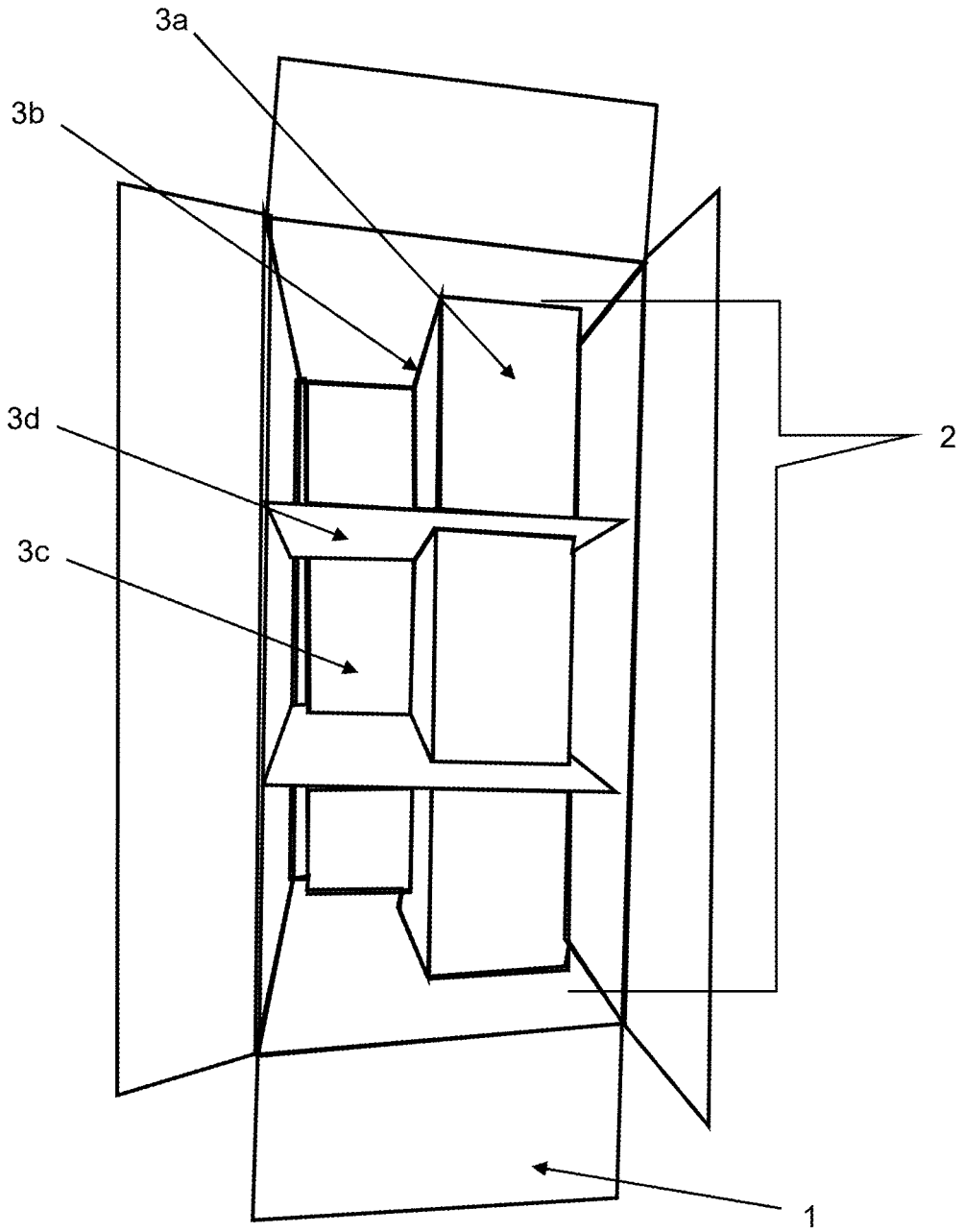
FIG. 2 is a top view of boot-type footwear packaging that includes a shelf for its care.
Figure 3:
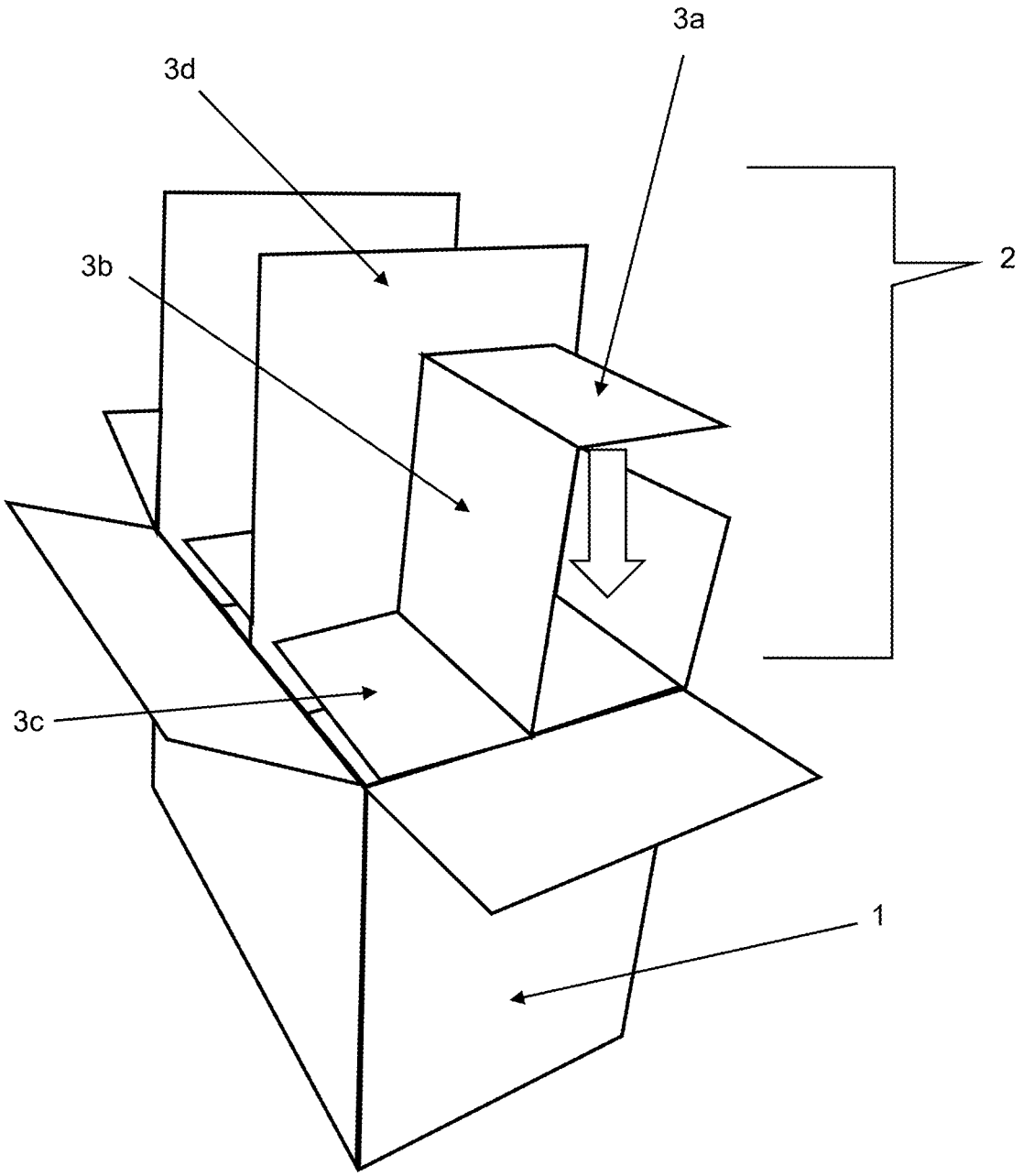
FIG. 3 is a conventional perspective view showing how to attach the shelf in the packing box for boot-type footwear including a shelf for its care.
Figure 4:
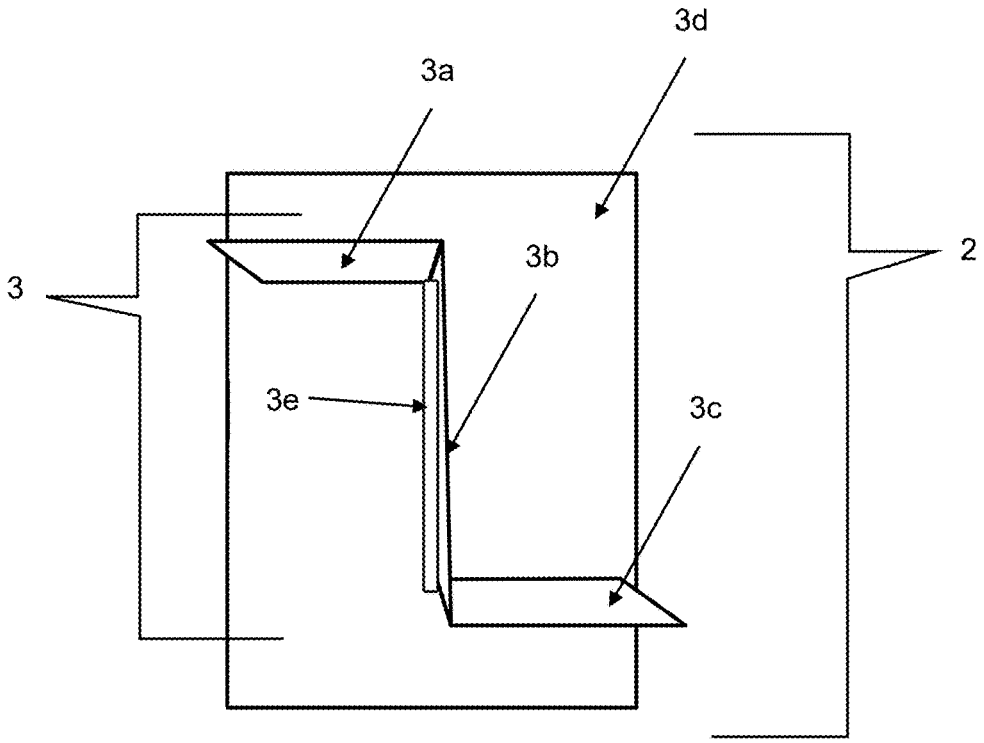
FIG. 4 is a side view of the packaging shelf for boot-type footwear that includes a shelf for its care.
Figure 5:
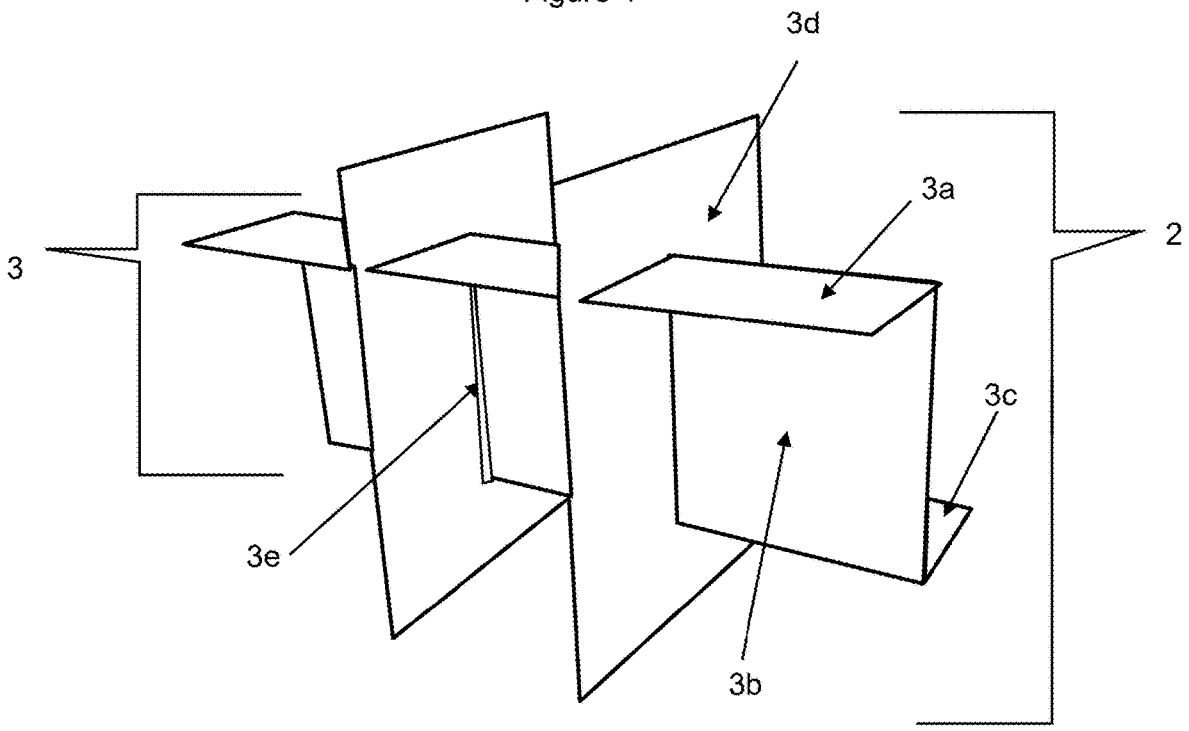
FIG. 5 is a rear perspective view of the packaging shelf for boot-type footwear that includes a shelf for its care.
Figure 6:
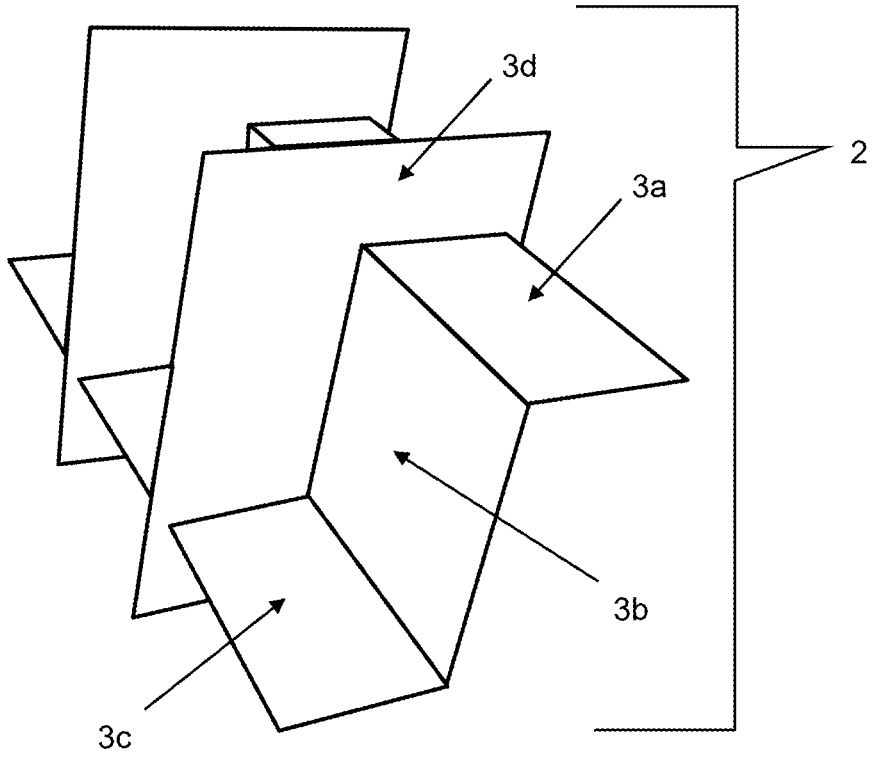
FIG. 6 is a front perspective view of the packaging shelf for boot-type footwear that includes a shelf for its care.
Figure 7:
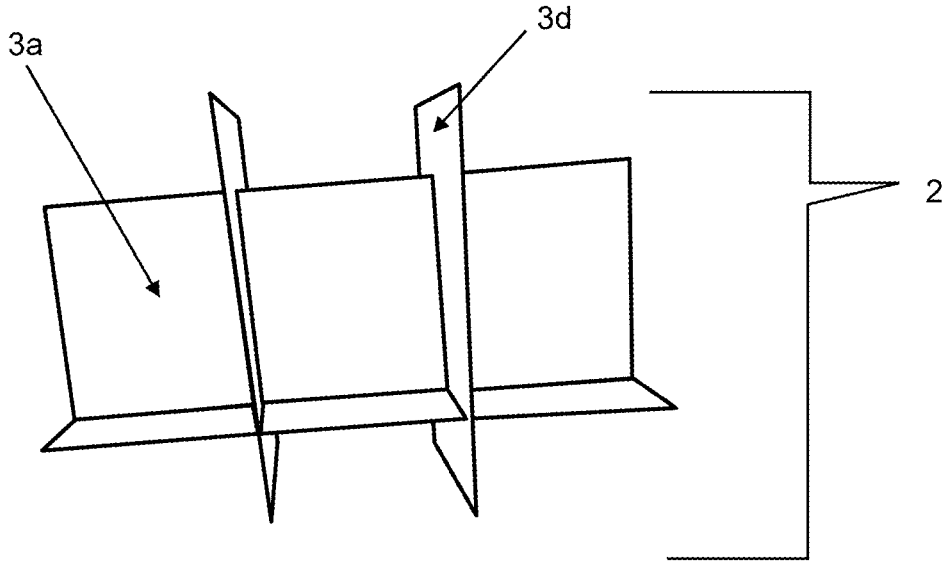
FIG. 7 is a front view of the packaging shelf for boot-type footwear that includes a shelf for its care.
Figure 8:
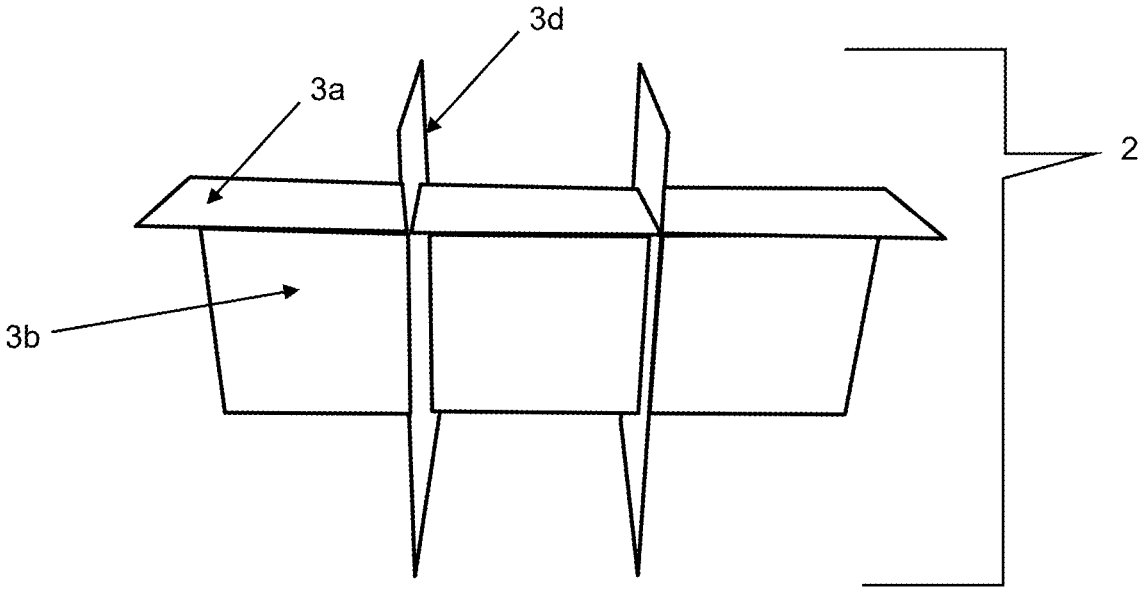
FIG. 8 is a rear view of the packaging shelf for boot-type footwear that includes a shelf for its care.
Figure 9:
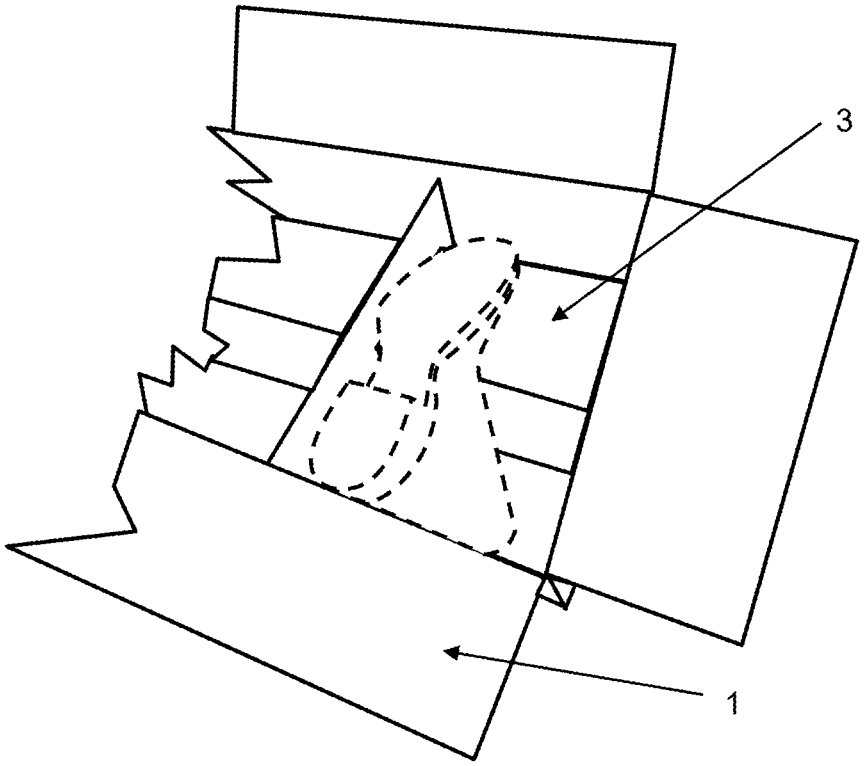
FIG. 9 is a conventional sectional perspective view of the boot-type footwear packaging that includes a shelf for its care, with a boot-type footwear indicating the manner of its placement inside.
Figure 10:
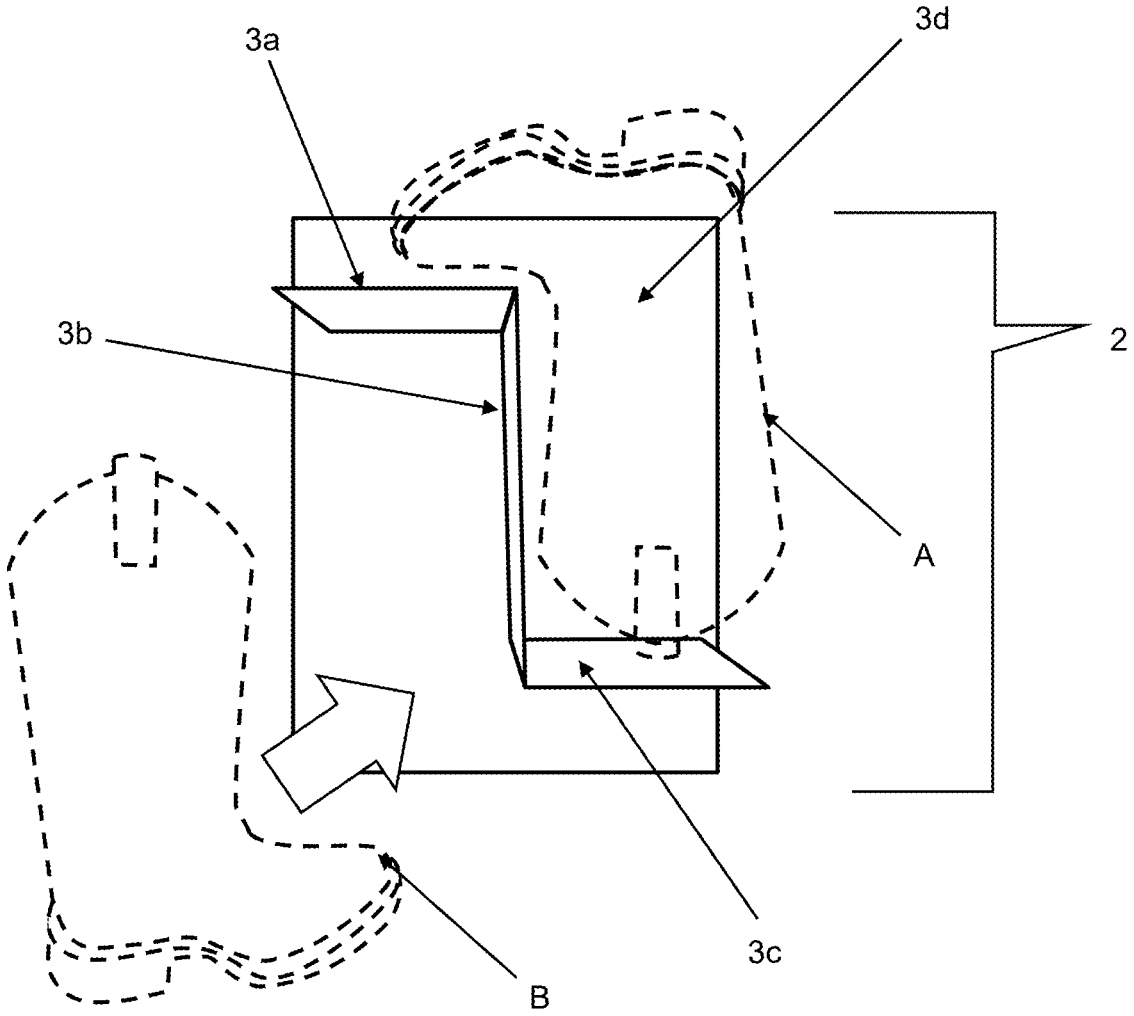
FIG. 10 is a side view of the boot-type footwear on the inside shelf of the boot-type footwear packaging that includes a shelf for its care.

Based on the above figures, the packaging for boot-type footwear that includes a shelf for its care, comprises two main elements, a box 1 and a shelf 2; wherein the shelf 2 which is inserted into the box 1 and consists of at least one piece 3 folded in a "z" shape wherein the parallel sections 3*a* and 3*c* are coupled in at least two walls 3*d* by passing the section 3*b* through a groove 3*e* found in the walls 3*d,* thereby shaping the shelf, when the sections 3*a* and 3*c* are arranged parallel to the conventional base of the box 1 then allowing at least one pair of footwear A and B to be placed under the shelf of the first footwear A and on the shelf the second footwear B.

Having sufficiently described my invention, which I consider as a novelty and therefore claim as my exclusive property the contents of the following claims:

1. A packaging for a boot footwear comprising:

a box; and a shelf, the shelf comprising:

at least one blank folded into a z-shape and at least two walls;

wherein the z-shape includes an upper section and a lower section, the upper and lower sections are parallel to a base of the box, and wherein each of the walls include a groove, each folded blank is coupled with the walls by being inserted into the grooves such that the z-shape is maintained and the folded blank is held in position within the box allowing at least a first boot footwear to be placed under the shelf and at least a second boot footwear to be placed above the shelf within the box.

* * * * *